US011562852B2

(12) United States Patent
Park et al.

(10) Patent No.: US 11,562,852 B2
(45) Date of Patent: Jan. 24, 2023

(54) COIL COMPONENT

(71) Applicant: SAMSUNG ELECTRO-MECHANICS CO., LTD., Suwon-si (KR)

(72) Inventors: No Il Park, Suwon-si (KR); Seung Mo Lim, Suwon-si (KR); Tai Yon Cho, Suwon-si (KR); In Young Kang, Suwon-si (KR); Byeong Cheol Moon, Suwon-si (KR); Doo Ho Park, Suwon-si (KR); Jeong Hoon Ryou, Suwon-si (KR); Tae Jun Choi, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 699 days.

(21) Appl. No.: 16/570,179

(22) Filed: Sep. 13, 2019

(65) Prior Publication Data

US 2020/0381170 A1 Dec. 3, 2020

(30) Foreign Application Priority Data

May 27, 2019 (KR) ..... 10-2019-0061915

(51) Int. Cl.
*H01F 17/00* (2006.01)
*H01F 17/04* (2006.01)
(Continued)

(52) U.S. Cl.
CPC ..... *H01F 27/292* (2013.01); *H01F 17/0013* (2013.01); *H01F 17/04* (2013.01);
(Continued)

(58) Field of Classification Search
CPC ..... H01F 17/0013; H01F 17/04; H01F 17/00; H01F 2017/048; H01F 2027/065;
(Continued)

(56) References Cited

U.S. PATENT DOCUMENTS 8,988,180 B2 3/2015 Arata et al.
2011/0006870 A1 1/2011 Sakamoto
(Continued)

FOREIGN PATENT DOCUMENTS

CN 103578708 A 2/2014
CN 104916390 A * 9/2015 ..... H01F 17/0013
(Continued)

OTHER PUBLICATIONS

Office Action issued in corresponding Chinese Patent Application No. 201911247829.0 dated Sep. 15, 2021, with English translation.
(Continued)

*Primary Examiner* — Timothy J Thompson
*Assistant Examiner* — Guillermo J Egoavil
(74) *Attorney, Agent, or Firm* — Morgan, Lewis & Bockius LLP

(57) ABSTRACT

A coil component includes a body having one surface and the other surface and a plurality of wall surfaces, first and second insulating substrates spaced apart from each other, first and second recesses disposed in both end surfaces of the body and extending to one surface of the body, first and second coil portions disposed on the first and second insulating substrates, one ends and the other ends of the first and second coil portions being exposed to the first and second recesses, first and second external electrodes disposed along an inner surface of the first recess and one surface of the body and connected to one ends of the first and second coil portions, and third and fourth external electrodes disposed along an inner surface of the second recess and one surface
(Continued)

of the body and connected to the other ends of the first and second coil portions.

20 Claims, 10 Drawing Sheets

(51) Int. Cl.
*H01F 27/255* (2006.01)
*H01F 27/28* (2006.01)
*H01F 27/29* (2006.01)
*H01F 27/06* (2006.01)

(52) U.S. Cl.
CPC ..... *H01F 27/255* (2013.01); *H01F 27/2804* (2013.01); *H01F 2017/048* (2013.01); *H01F 2027/065* (2013.01)

(58) Field of Classification Search
CPC .. H01F 27/255; H01F 27/2804; H01F 27/292; H01F 27/28; H01F 27/29; H01F 27/24; H01F 27/2828; H01F 27/30; H01F 37/00; H01F 41/00; H01F 41/041
USPC ..... 336/199
See application file for complete search history.

(56) References Cited

U.S. PATENT DOCUMENTS

| | | | | |
|---|---|---|---|---|
| 2014/0022041 | A1 | 1/2014 | Park et al. | |
| 2014/0210586 | A1* | 7/2014 | Atsumi | H01F 27/292 336/192 |
| 2015/0042436 | A1* | 2/2015 | Arimitsu | H01F 17/045 336/192 |
| 2016/0086725 | A1* | 3/2016 | Igarashi | H01F 27/2823 336/83 |
| 2016/0099100 | A1 | 4/2016 | Park et al. | |
| 2016/0189850 | A1 | 6/2016 | Lee | |
| 2016/0217917 | A1* | 7/2016 | Jeong | H01F 27/292 |
| 2016/0260538 | A1 | 9/2016 | Tanaka et al. | |
| 2016/0268038 | A1 | 9/2016 | Choi | |
| 2017/0148561 | A1* | 5/2017 | Yoon | H05K 1/181 |
| 2017/0236632 | A1 | 8/2017 | Park et al. | |
| 2017/0323725 | A1* | 11/2017 | Iso | H01G 4/232 |
| 2018/0019176 | A1 | 1/2018 | Kanbe | |
| 2018/0122553 | A1 | 5/2018 | Kim et al. | |
| 2018/0182537 | A1 | 6/2018 | Shimizu et al. | |
| 2019/0019615 | A1 | 1/2019 | Lee et al. | |
| 2020/0020477 | A1 | 1/2020 | Kang et al. | |
| 2020/0118729 | A1* | 4/2020 | Lim | H01F 27/24 |

FOREIGN PATENT DOCUMENTS

| | | | |
|---|---|---|---|
| CN | 104916390 | A | 9/2015 |
| CN | 105742041 | A | 7/2016 |
| CN | 105793936 | A | 7/2016 |
| CN | 105957692 | A | 9/2016 |
| CN | 107622862 | A | 1/2018 |
| CN | 108022732 | A | 5/2018 |
| JP | 2005-310863 | A | 11/2005 |
| JP | 2007-165477 | A | 6/2007 |
| JP | 5598492 | B2 | 10/2014 |
| JP | 2018-107346 | A | 7/2018 |
| KR | 10-1548862 | B1 | 8/2015 |
| KR | 10-2016-0092674 | A | 8/2016 |
| KR | 10-2017-0058609 | A | 5/2017 |
| KR | 10-2019-0007158 | A | 1/2019 |
| KR | 10-2020-0006450 | A | 1/2020 |
| KR | 10-2020-0041696 | A | 4/2020 |

OTHER PUBLICATIONS

Yingxian Fan, Research on Manufacturing Process and Miniaturization of Multilayer Chip Inductor, China Master's Theses Full-text Database (Basic Science Part), pp. C042-C165, Dec. 2011 (English Abstract Included).
Office Action issued in corresponding Korean Patent Application No. 10-2019-0061915 dated May 18, 2020, with English translation.

* cited by examiner

COIL COMPONENT

CROSS-REFERENCE TO RELATED APPLICATION(S)

This application claims the benefit under 35 USC 119 (a) of Korean Patent Application No. 10-2019-0061915 filed on May 27, 2019 in the Korean Intellectual Property Office, the entire disclosure of which is incorporated herein by reference for all purposes.

TECHNICAL FIELD

The present disclosure relates to a coil component.

BACKGROUND

Inductors, coil components, are representative passive elements used for electronic devices, together with resistors and capacitors.

As electronic devices have been increasingly multifunctionalized and miniaturized, the number of electronic components used in electronic devices has been increasing, while becoming smaller in size.

Accordingly, even in a coupled inductor having a plurality of coil portions, there is an increasing need to reduce the volume occupied by external electrodes while significantly reducing loss of a magnetic substance.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

An aspect of the present disclosure is to provide a coil component that may be lightly miniaturized.

An aspect of the present disclosure is to provide a coil component in which a lower electrode structure may be easily formed.

An aspect of the present disclosure is to provide a coil component in which loss of a magnetic substance may be significantly reduced.

According to an aspect of the present disclosure, a coil component includes a body having a first surface and a second surface opposing each other, and a plurality of wall surfaces respectively connecting the first surface and the second surface of the body, a first insulating substrate and a second insulating substrate spaced apart from each other in the body, a first recess and a second recess disposed in both end surfaces of the body, opposing each other, respectively, among the plurality of wall surfaces of the body, the first and second recesses extending to the first surface of the body, a first coil portion and a second coil portion disposed on the first and second insulating substrates, respectively, a first end of each of the first and second coil portions being exposed to the first recess and a second end of each of the first and second coil portions being exposed to the second recess, a first external electrode and a second external electrode respectively disposed along an inner surface of the first recess and the first surface of the body, and spaced apart from each other and connected to the first ends of the first and second coil portions, respectively, and a third external electrode and a fourth external electrode respectively disposed along an inner surface of the second recess and the first surface of the body, and spaced apart from each other and connected to the second ends of the first and second coil portions, respectively.

BRIEF DESCRIPTION OF THE DRAWINGS

Throughout the drawings and the detailed description, the same reference numerals refer to the same elements. The drawings may not be to scale, and the relative size, proportions, and depictions of elements in the drawings may be exaggerated for clarity, illustration, and convenience.

DETAILED DESCRIPTION

Figure 1:
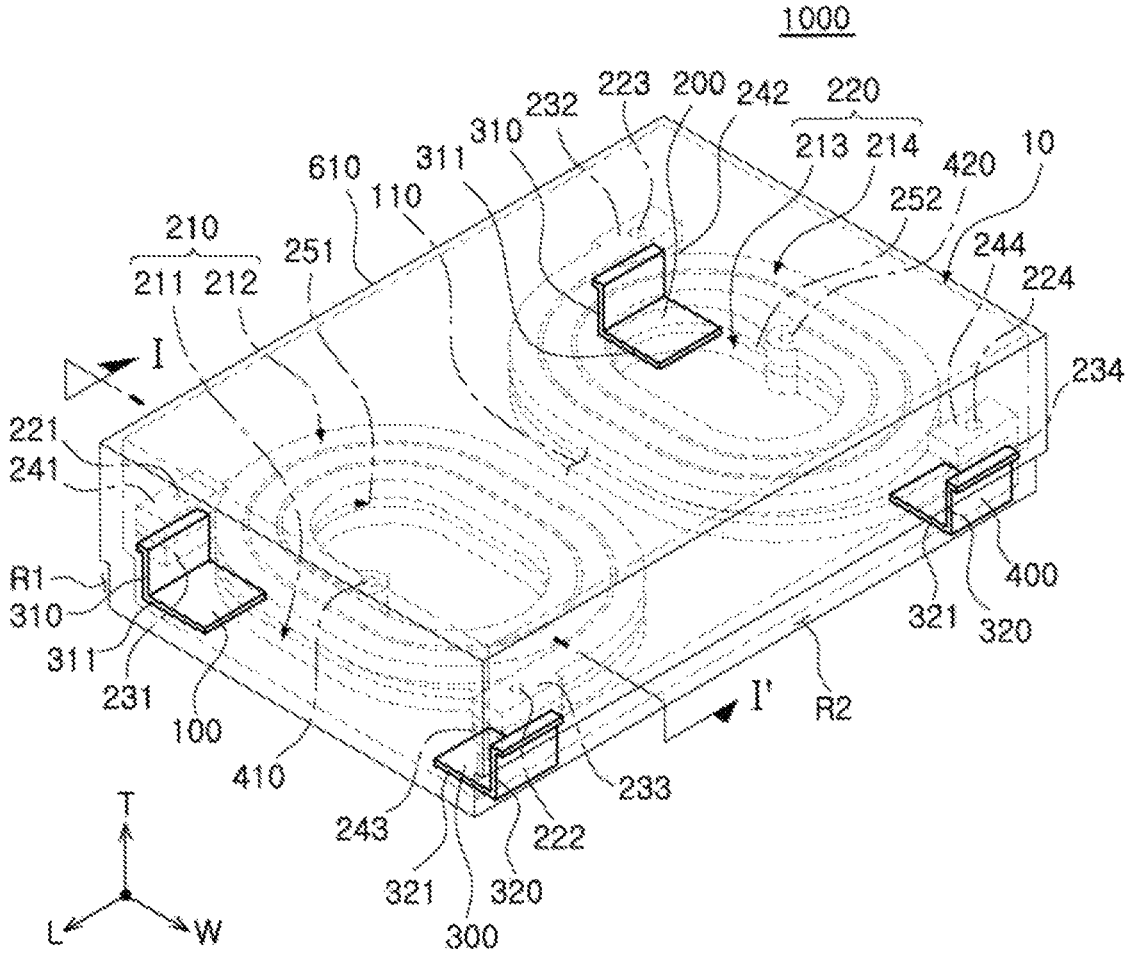
FIG. 1 is a side perspective view schematically illustrating a coil component according to a first embodiment of the present disclosure.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed, as will be apparent to one of ordinary skill in the art, with the exception of operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

Hereinafter, examples of the present disclosure will be described in detail with reference to the accompanying drawings so that those skilled in the art may easily carry out the present disclosure.

In the drawing, the L direction may be defined as a first direction or a length direction, the W direction as a second direction or a width direction, and the T direction as a third direction or a thickness direction.

Hereinafter, a coil component according to an embodiment will be described in detail with reference to the accompanying drawings. Referring to the accompanying drawings, the same or corresponding components are denoted by the same reference numerals, and duplicate descriptions thereof will be omitted.

Various kinds of electronic components are used in electronic devices. Various types of coil components may be suitably used for noise removal or the like between these electronic components.

For example, the coil component in an electronic device may be used as a power inductor, a high frequency (HF) inductor, a general bead, a bead for high frequency (GHz Bead), a common mode filter, or the like.

First Embodiment

Figure 2:
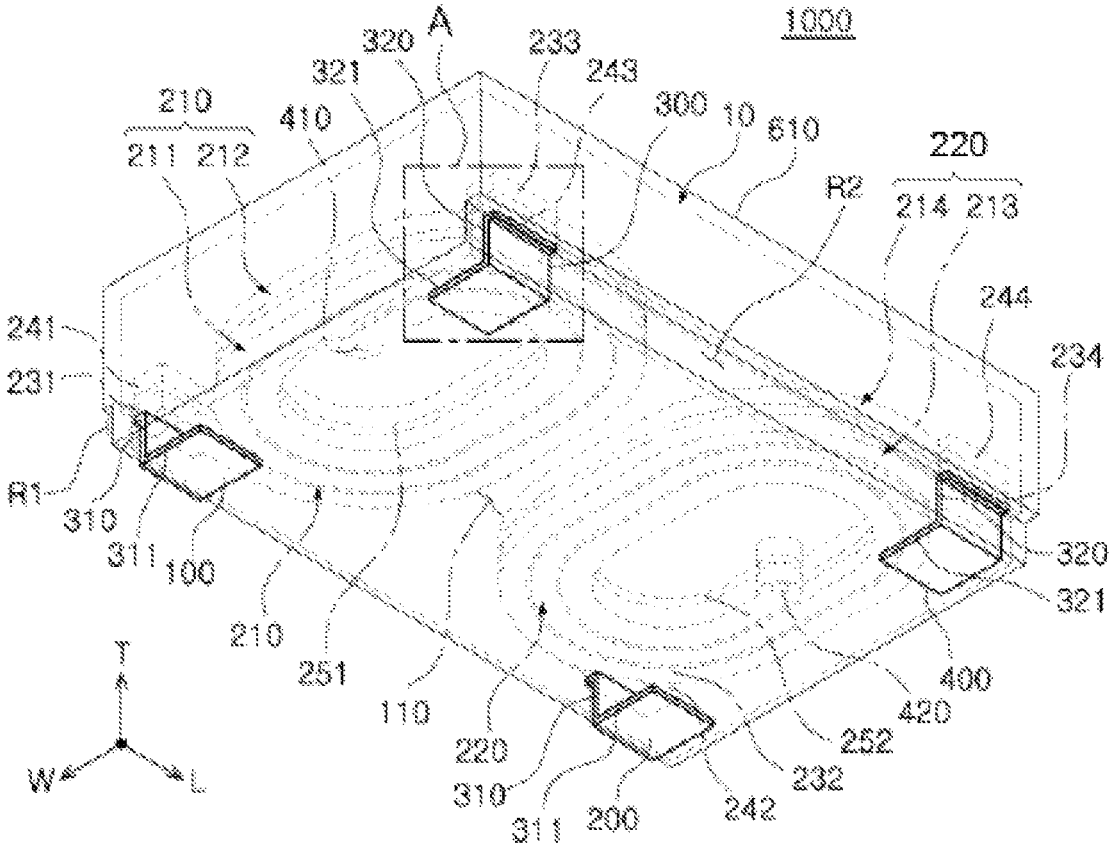
FIG. 2 is a side perspective view of a coil component according to a first embodiment of the present disclosure, viewed from the lower side.
Figure 3:
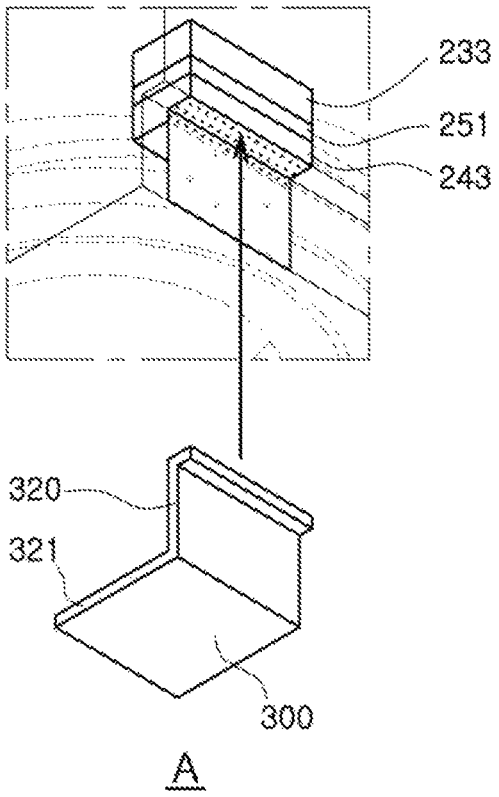
FIG. 3 is an enlarged view illustrating a coupling relationship between an external electrode and a lead portion of region A of FIG. 2.
Figure 4:
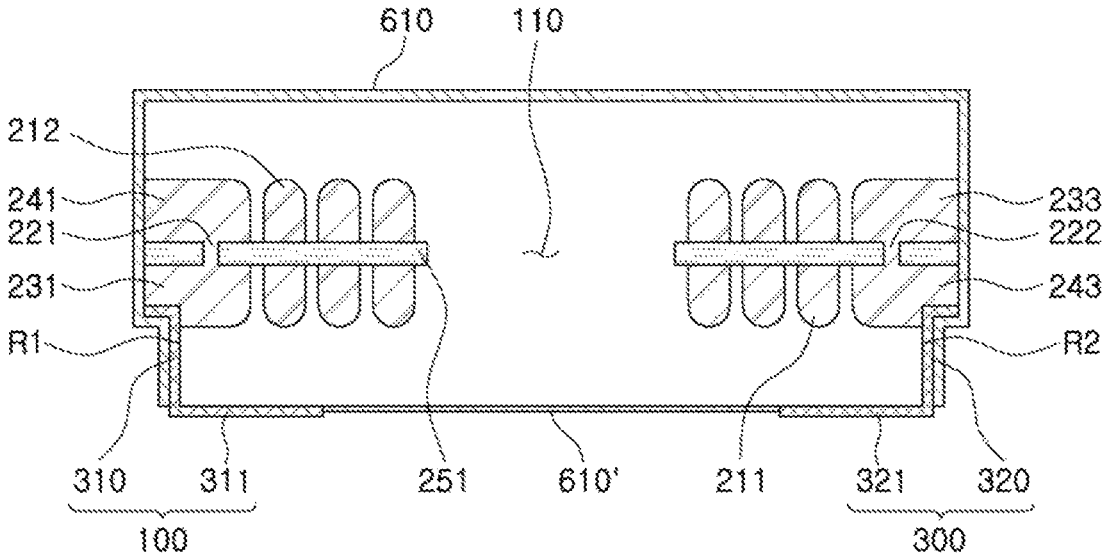
FIG. 4 is a cross-sectional view taken along line I-I' in FIG. 1.

FIG. 1 is a side perspective view schematically illustrating a coil component according to a first embodiment. FIG. 2 is a side perspective view of a coil component according to a first embodiment, viewed from the lower side. FIG. 3 is an enlarged view of region A of FIG. 2. FIG. 4 is a cross-sectional view taken along line I-I' in FIG. 1.

Referring to FIGS. 1 to 4, a coil component 1000 according to a first embodiment includes a body 10, insulating substrates 251 and 252, recesses R1 and R2, coil portions 210 and 220, and external electrodes 100, 200, 300 and 400, and may further include an insulating layer 610.

The body 10 forms the appearance of the coil component 1000 according to an embodiment, and includes coil portions embedded therein.

The body 10 may be formed to have a substantially hexahedral shape.

Referring to FIGS. 1 and 2, the body 10 has a first surface and a second surface opposing each other in a length direction L, a third surface and a fourth surface opposing each other in a width direction W, and a fifth surface and a sixth surface opposing each other in a thickness direction T. The first to fourth surfaces of the body 10 respectively correspond to the wall surface of the body 10 connecting the fifth and sixth surfaces of the body 10. The fifth and sixth surfaces of the body may refer to the other surface and one surface of the body, and the third surface and the fourth surface of the body opposing each other among the plurality of wall surfaces of the body may refer to both end surfaces of the body.

In the case of the coil component 1000 according to an embodiment including the external electrodes 100, 200, 300 and 400 to be described later, a filling portion 510 and the insulating layer 610, the body 10 may be formed to have a length of 2.0 mm, a width of 1.2 mm, and a thickness of 0.65 mm, but an embodiment thereof is not limited thereto.

The body 10 may include a magnetic material and a resin. In detail, the body 10 may be formed by laminating one or more magnetic composite sheets containing a resin and a magnetic material dispersed in the resin. The body 10 may also have a structure other than the structure in which the magnetic material is dispersed in the resin. For example, the body 10 may be formed of a magnetic material such as ferrite.

The magnetic material may be ferrite or a magnetic metal powder.

The ferrite powder may be at least one of spinel type ferrites such as Mg—Zn type, Mn—Zn type, Mn—Mg type, Cu—Zn type, Mg—Mn—Sr type, Ni—Zn type and the like, hexagonal ferrites such as Ba—Zn type, Ba—Mg type, Ba—Ni type, Ba—Co type, Ba—Ni—Co type and the like, garnet type ferrites such as a Y system and the like, and Li-based ferrites.

The magnetic metal powder may include one or more selected from the group consisting of iron (Fe), silicon (Si), chromium (Cr), cobalt (Co), molybdenum (Mo), aluminum (Al), niobium (Nb), copper (Cu), and nickel (Ni). For example, the magnetic metal powder may be at least one of pure iron powder, Fe—Si-based alloy powder, Fe—Si—Al based alloy powder, Fe—Ni based alloy powder, Fe—Ni—Mo based alloy powder, Fe—Ni—Mo—Cu based alloy powder, Fe—Co based alloy powder, Fe—Ni—Co based alloy powder, Fe—Cr based alloy powder, Fe—Cr—Si based alloy powder, Fe—Si—Cu—Nb based alloy powder, Fe—Ni—Cr based alloy powder, and Fe—Cr—Al based alloy powder.

The magnetic metal powder may be amorphous or crystalline. For example, the magnetic metal powder may be an Fe—Si—B—Cr amorphous alloy powder, but is not limited thereto.

The ferrite particle and the magnetic metal powder particles may each have an average diameter of about 0.1 μm to 30 μm, but embodiments thereof are not limited thereto.

The body 10 may include two or more kinds of magnetic materials dispersed in a resin. In this case, different kinds of magnetic materials mean that the magnetic materials dispersed in the resin are distinguished from each other by any one of an average diameter, a composition, crystallinity and a shape.

The resin may include, but is not limited to, an epoxy, polyimide, a liquid crystal polymer, or the like, alone or in combination.

The body 10 includes a core 110 penetrating through the coil portions 210 and 220 to be described later. The core 110 may be formed by filling through-holes of the coil portions 210 and 220 with a magnetic composite sheet, but an embodiment thereof is not limited thereto. In this embodiment, for convenience of explanation, the core 110 refers to both of cores formed by the first coil portion 210 and the second coil portion 220.

The first and second insulating substrates 251 and 252 are embedded in the body 10 and are spaced apart from each other in the body. The insulating substrates 251 and 252 support the coil portions 210 and 220 to be described later.

The insulating substrates 251 and 252 may be formed of an insulating material including a thermosetting insulating resin such as an epoxy resin, a thermoplastic insulating resin such as polyimide or a photoimageable dielectric resin, or may be formed of an insulating material in which this insulating resin is impregnated with a reinforcing material such as a glass fiber or an inorganic filler. For example, the insulating substrates 251 and 252 may be formed of an insulating material such as prepreg, Ajinomoto Build-up Film (ABF), FR-4, bismaleimide triazine (BT) resin, and a Photo Imageable Dielectric (PID) resin, or the like, but a material thereof is not limited thereto.

The inorganic filler may be one or more selected from the group consisting of silica ($SiO_2$), alumina ($Al_2O_3$), silicon carbide (SiC), barium sulphate ($BaSO_4$), talc, mud, mica powder, aluminum hydroxide ($AlOH_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$) and calcium zirconate ($CaZrO_3$).

When the insulating substrates 251 and 252 are formed of an insulating material including a reinforcing material, the insulating substrates 251 and 252 may provide relatively excellent rigidity. When the insulating substrates 251 and 252 are formed of an insulating material not containing a glass fiber, the insulating substrates 251 and 252 may be advantageous in terms of thinning the thickness of entirety of the coil portions 210 and 220. When the insulating substrates 251 and 252 are formed of an insulating material including a photoimageable dielectric resin, the number of processes for forming the first and second coil portions 210 and 220 is reduced, which is advantageous in reducing the production cost and in forming minute vias.

The recesses R1 and R2 are formed on both surfaces opposing each other among a plurality of wall surfaces of the body, and extend to one surfaces of the body, respectively. Referring to FIGS. 1 and 2, a first recess R1 is formed on the third surface to extend to the sixth surface, and a second recess R2 is formed on the fourth surface opposing the third surface to extend to the sixth surface. For example, in this embodiment, the first and second recesses R1 and R2 are formed on the third and fourth surfaces of the first to fourth surfaces of the rectangular parallelepiped body 10, opposing each other in the width direction W, respectively. The recesses R1 and R2 are formed along the entirety of edge regions formed respectively by the third and fourth surfaces of the body 10 and the sixth surface of the body 10. The recesses R1 and R2 do not extend to the fifth surface of the body 10. For example, the recesses R1 and R2 do not penetrate through the body 10 in the thickness direction T of the body 10.

The recesses R1 and R2 may be formed by pre-dicing a boundary line (a dicing line or a singulation line) between the bodies 10 on one side of a coil bar. The width of the pre-dicing tip used for pre-dicing is wider than a width of the dicing line of the coil bar. In this case, the coil bar indicates that a plurality of bodies 10 are connected to each other in the length direction and the width direction of the body 10. In addition, the width of the dicing line refers to the width of a full-dicing tip for individualizing the coil bar.

The depths of the recesses R1 and R2 in pre-dicing are adjusted in such a manner that a portion of each of lead portions 231, 232, 233 and 234 to be described later may be removed together with a portion of the body 10. For example, depths of the recesses R1 and R2 are adjusted such that the lead portions 231, 232, 233 and 234 are exposed to inner surfaces of the recesses R1 and R2. On the other hand, the depths of the recesses R1 and R2 in pre-dicing are adjusted to not entirely penetrate through one side and the other side of the coil bar. As a result, even after the pre-dicing, the coil bar may be maintained in a state in which a plurality of bodies are connected to each other.

The inner walls of the recesses R1 and R2 and the bottom surfaces of the recesses R1 and R2, which are the inner surfaces of the recesses R1 and R2, constitute the surface of the body 10. For the sake of convenience of explanation, the inner walls of the recesses R1 and R2 and the bottom surfaces of the recesses R1 and R2 are distinguished from the surface of the body 10.

The coil portions 210 and 220 are embedded in the body 10 to exhibit characteristics of coil components. For example, when the coil component 1000 of the embodiment is used as a power inductor, the coil portions 210 and 220 may function to stabilize the power of an electronic device by storing an electric field as a magnetic field to maintain an output voltage.

The coil portions 210 and 220 applied to this embodiment include conductor patterns 211, 212, 213 and 214, vias 221 and 222, lead portions 231, 232, 233 and 234 and auxiliary lead portions 241, 242, 243 and 244.

In detail, the first and second coil portions 210 and 220 are disposed on the first and second insulating substrates 251 and 252, respectively. One end of each of the first and second coil portions 210 and 220 may be exposed to the first recess R1, and the other end of each of the first and second coil portions 210 and 220 may be exposed to the second recess R2. The upper surfaces of the insulating substrates 251 and 252 refer to the other surfaces of the insulating substrates 251 and 252. The lower surfaces of the insulating substrates 251 and 252 refer to one surfaces of the insulating substrates 251 and 252.

As described later, one end portion and the other end portion of the first coil portion 210 include first and third lead portions 231 and 233, respectively, and one end portion and the other end portion of the second coil portion 220 include second and fourth lead portions 232 and 234, respectively. In this embodiment, a first conductor pattern 211 and the first lead portion 231 are disposed on a lower surface of the first insulating substrate 251 facing the sixth surface of the body 10, and a second conductor pattern 212 and the third lead portion 233 are disposed on an upper surface of the first insulating substrate 251 facing the fifth surface of the body 10. A third conductor pattern 213 is disposed on a lower surface of the second insulating substrate 252 spaced apart from the first insulating substrate 251, and a fourth conductor pattern 214 is disposed on an upper surface of the second insulating substrate 252. The first conductor pattern 211 and the first lead portion 231 are in contact with each other and connected to each other, and the second conductor pattern 212 and the third lead portion 233 are in contact with each other and connected to each other. The third conductor pattern 213 and the fourth lead portion 234 are in contact with each other and connected to each other, and the fourth conductor pattern 214 and the second lead portion 232 are in contact with each other and connected to each other. The first and second vias 221 and 222 penetrate through the first insulating substrate 251 to connect the first conductor pattern 211 and the second conductor pattern 212 to each other. Thus, the first coil portion 210 may function as a single coil overall. The third conductor pattern 213 and the fourth conductor pattern 214 disposed on the second insulating substrate 252 are electrically connected to each other by the third and fourth vias 223 and 224 penetrating through the second insulating substrate 252. Therefore, the second coil portion 220 may function as a single coil overall.

Referring to FIGS. 2 and 4, one end portion of the first coil portion 210 includes a first auxiliary lead portion 241 disposed on one surface of the first insulating substrate 251 and facing the first lead portion 231, and the other end portion of the first coil portion 210 includes a third auxiliary lead portion 243 disposed on the other surface of the first insulating substrate 251 and facing the third lead portion 233. One end portion of the second coil portion 220 includes a second auxiliary lead portion 242 disposed on one surface of the second insulating substrate 252 and facing the second lead portion 232, and the other end portion of the second coil portion 220 includes a fourth auxiliary lead portion 244 disposed on the other surface of the second insulating substrate 252 and facing the fourth lead portion 234. The first lead portion 231 of the first coil portion 210 and the second auxiliary lead portion 242 of the second coil portion 220 are respectively exposed to the first recess R1. The third auxiliary lead portion 243 of the first coil portion 210 and the fourth lead portion 244 of the second coil portion 220 may be respectively exposed to the second recess R2. The first auxiliary lead portion 241 of the first coil portion 210 and the second lead portion 232 of the second coil portion 220 are respectively exposed to the first recess R1. The third lead portion 233 of the first coil portion 210 and the fourth auxiliary lead portion 244 of the second coil portion 220 are respectively exposed to the second recess R2.

Referring to FIG. 4, the first to fourth auxiliary lead portions 241, 242, 243 and 244 are disposed to correspond to the first to fourth lead portions 231, 232, 233 and 234, respectively. Exposed lengths of one ends and the other ends of the first and second coil portions 210 and 220, exposed to the recesses R1 and R2 through the auxiliary lead portions 241, 242, 243 and 244, in the thickness direction may be substantially the same as each other, as described later.

Each of the first conductor pattern 211 and the second conductor pattern 212 and each of the third conductor pattern 213 and the fourth conductor pattern 214 may have a flat spiral shape while forming at least one turn on the core 110 as an axis. As an example, the first conductor pattern 211 may format least one turn around the core 110 on a lower surface of the first insulating substrate 251.

A portion of the lead portions 231, 232, 233 and 234 and the auxiliary lead portions 241, 242, 243 and 244 are exposed to the inner surfaces of the recesses R1 and R2. Referring to FIG. 2, the first lead portion 231 and the second auxiliary lead portion 242 may be exposed to the inner wall and the bottom surface of the first recess R1, respectively, and the third auxiliary lead portion 243 and the fourth lead portion 234 may be exposed to the inner wall and the bottom surface of the second recess R2, respectively. In forming the first recess R1, a portion of each of the first lead portion 231 and the second auxiliary lead portion 242 is removed together with a portion of the body 10. In forming the second recess R2, a portion of each of the third auxiliary lead portion 243 and the fourth lead portion 234 is removed together with a portion of the body 10. On the first lead portion 231, the second auxiliary lead portion 242, the third auxiliary lead portion 243 and the fourth lead portion 234, exposed to the inner walls and the bottom surfaces of the recesses R1 and R2, the first to fourth external electrodes 100, 200, 300 and 400 to be described later are formed.

At least one of the conductor patterns 211, 212, 213 and 214, the vias 221, 222, 223 and 224, the lead portions 231, 232, 233 and 234, and the auxiliary lead portions 241, 242, 243 and 244 may include at least one or more conductive layers.

As an example, when the second conductor pattern 212, the first and second vias 221 and 222, the third lead portion 233, and the first auxiliary lead portion 241 are formed on the other surface of the first insulating substrate 251 by plating, the second conductor pattern 212, the first and second vias 221 and 222, the third lead portion 233 and the first auxiliary lead portion 241 may each include a seed layer of an electroless plating layer or the like, and an electroplating layer. In this case, the electroplating layer may have a single-layer structure or a multilayer structure. The electroplating layer of the multilayer structure may be formed by a conformal film structure in which one electroplating layer is covered by another electroplating layer, and may also be formed to have a shape in which another electroplating layer is stacked only on one surface of one electroplating layer. A seed layer of the second conductor pattern 212, seed layers of the first and second vias 221 and 222, a seed layer of the third lead portion 233, and a seed layer of the first auxiliary lead portion 231 are integrally formed such that a boundary therebetween may not be formed, but an embodiment thereof is not limited thereto.

Each of the conductor patterns 211, 212, 213 and 214, the vias 221, 222, 223 and 224, the lead portions 231, 232, 233 and 234 and the auxiliary lead portions 241, 242, 243 and 244 may be respectively formed of a conductive material such as copper (Cu), aluminum (Al), silver (Ag), tin (Sn), gold (Au), nickel (Ni), lead (Pb), titanium (Ti) or alloys thereof, but an embodiment thereof is not limited thereto.

The external electrodes 100, 200, 300 and 400 are respectively formed along the inner surfaces of the recesses R1 and R2 and one surface of the body 10 and are connected to the coil portions 210 and 220. Referring to FIGS. 1 and 2, the first and second external electrodes 100 and 200 are formed along the inner surface of the first recess R1 and one surface of the body 10, and are spaced apart from each other to be connected to the ends of the first and second coil portions 210 and 220, respectively. The third and fourth external electrodes 300 and 400 are formed along the inner surface of the second recess R2 and one surface of the body 10 and are spaced apart from each other to be connected to the other ends of the first and second coil portions 210 and 220, respectively. Referring to FIGS. 3 to 7, the first to fourth external electrodes 100, 200, 300 and 400 include connection portions 310 and 320 disposed in the first and second recesses R1 and R2, respectively, and extension portions 311 and 321 extending on one surface of the body 10. In an embodiment of the present disclosure, for convenience of explanation, the connection portion will be described with a first connection portion 310 disposed in the first recess R1 to be connected to the first or second external electrode 100 or 200 and a second connection portion 320 disposed in the second recess R2 to be connected to the third or fourth external electrode 300 or 400. Similarly, a first extension portion 311 extending from the first recess R1 to one surface of the body and a second extension portion 321 extending from the second recess R2 to one surface of the body will be described.

The connection portions 310 and 320 and the extension portions 311 and 321 are integrally formed with respect to each other, respectively, on the bottom surfaces of the first and second recesses R1 and R2, the inner walls of the first and second recesses R1 and R2 and one surface of the body are integrally formed along one surface. Referring to FIG. 3, the third external electrode 300 includes a connection portion 320 disposed in a region to which the third auxiliary lead portion 243 is exposed, and in contact with the third auxiliary lead portion 243 to be connected thereto, and an extension portion 321 extending from the connection portion 320 to one surface of the body. The extension portions 320 and the connection portions 321 extend on the inner surfaces of the recesses R1 and R2 and on one surface of the body 10 in a conformal film form to constitute the third external electrode 300. Referring to FIG. 4, the first external electrode 100 includes a connection portion 310 disposed in a region to which the first lead portion 231 is exposed, and in contact with the first lead portion 231 to be connected thereto, and an extension portion 311 extending from the connection portion 310 to one surface of the body. The third external electrode 300 includes a connection portion 320 disposed in a region to which the third auxiliary lead portion 243 is exposed, and in contact with the third auxiliary lead portion 243 to be connected thereto, and an extension portion 321 extending from the connection portion 320 to one surface of the body. Although not illustrated in detail, the fourth external electrode 400 includes a connection portion 320 disposed in a region to which the fourth auxiliary lead portion 244 is exposed, and in contact with the fourth auxiliary lead portion 244 to be connected thereto, and an extension portion 321 extending from the connection portion 320 to one surface of the body. The connection portions 310 and 320 and the extension portions 311 and 321 are respectively disposed in conformal film form along the inner surfaces of the recesses R1 and R2 and the sixth surface of the body 10.

The external electrodes 100, 200, 300 and 400 are spaced apart from each other. The first external electrode 100 and the third external electrode 300 are electrically connected by the first coil portion 210, but are spaced apart from each other on the surfaces of the body 10 and the recesses R1 and R2. The second external electrode 200 and the fourth external electrode 400 are electrically connected by the second coil portion 220, but are spaced apart from each other on the surfaces of the body 10 and the recesses R1 and R2.

Each of the external electrodes 100, 200, 300 and 400 may be integrally formed on the inner surfaces of the recesses R1 and R2 and the sixth surface of the body 10. For example, the connection portion 310 and the extension portion 311 of the first external electrode 100 may be formed together to be integrated with each other in the same process, and the connection portion 310 and the extension portion 311 of the third external electrode 300 may be formed together to be integrated with each other in the same process. The external electrodes 100, 200, 300 and 400 may be formed by a thin film process such as a sputtering process.

The external electrodes 100, 200, 300 and 400 may be formed using a conductive material such as copper (Cu), aluminum (Al), silver (Ag), tin (Sn), gold (Au), nickel (Ni), lea (Pb), chrominum (Cr), titanium (Ti), or alloys thereof, but examples thereof are not limited thereto. The external electrodes 100, 200, 300 and 400 may be formed of a single layer or a plurality of layers.

The insulating layer 610 is disposed on the first to fourth external electrodes 100, 200, 300 and 400. The insulating layer 610 is formed along the inner walls and the bottom surfaces of the first and second recesses R1 and R2, to cover respective connection portions 310 and 320 of the first to fourth external electrodes 100, 200, 300 and 400, while exposing respective extension portions 311 and 321 of the first to fourth external electrodes 100, 200, 300 and 400.

The insulating layer 610 may be formed of a thermoplastic resin such as a polystyrene type resin, a vinyl acetate type resin, a polyester type resin, a polyethylene type resin, a polypropylene type resin, a polyamide type resin, a rubber type resin or an acrylic type resin, a thermosetting resin such as a phenol type resin, an epoxy type resin, a urethane type resin, a melamine type resin or an alkyd type resin, a photoimageable resin, parylene, $SiO_x$, or $SiN_x$.

The insulating layer 610 may be formed by applying a liquid insulating resin to the body 10, by laminating an insulating film such as a dry film (DF) on the body 10, or by forming an insulating material on the surface of the body 10 and on the connection portions 310 and 320 by vapor deposition. In the case of the insulating film, an Ajinomoto Build-up Film (ABF) or a polyimide film not containing a photoimageable dielectric resin may be used.

The insulating layer 610 may be formed in a thickness range of 10 nm to 100 μm. If the thickness of the insulating layer 610 is less than 10 nm, characteristics of the coil component such as the Q factor may be decreased. If the thickness of the insulating layer 610 is more than 100 μm, the total length, width and thickness of the coil portion increase, which is disadvantageous for thinning.

Although not illustrated, in this embodiment, an insulating film may be further included such that it is formed along the surfaces of the lead portions 231, 232, 233 and 234 except for one surfaces of the lead portions 231, 232, 233 and 234 exposed to the recesses R1 and R2, the surfaces of the conductor patterns 211, 212, 213 and 214, and the surfaces of the insulating substrates 251 and 252. The insulating film protects the lead portions 231, 232, 233 and 234 and the conductor patterns 211, 212, 213 and 214, insulate the lead portions 231, 232, 233 and 234 from the body 10, and may include a known insulating material such as parylene or the like. Any insulating material included in the insulating film may be used, and the insulating material is not particularly limited. The insulating film may be formed by vapor deposition or the like, but an embodiment thereof is not limited thereto. For example, the insulating film may also be formed by laminating an insulating film on both surfaces of the insulating substrates 251 and 252.

Further, in the case of this embodiment, an additional insulating layer 610' may be further included, which is distinguished from the above-described insulating layer 610 and is formed to be in contact with at least one of the first to sixth surfaces of the body 10. Byway of example, the additional insulating layer 610' extends to a lower surface of the body 10 along a surface in contact with the extension portions 311 and 321. As such, the additional insulating layer 610' may be formed on the sixth surface of the body to expose the extension portions 311 and 321.

The additional insulating layer 610' may be formed to include a thermoplastic resin such as a polystyrene type resin, a vinyl acetate type resin, a polyester type resin, a polyethylene type resin, a polypropylene type resin, a polyamide type resin, a rubber type resin or an acrylic type resin, a thermosetting resin such as a phenol type resin, an epoxy type resin, a urethane type resin, a melamine type resin or an alkyd type resin, a photoimageable resin, parylene, $SiO_x$, or $SiN_x$. The additional insulating layer 610' may be formed by laminating an insulating film on the surface of the body 10 or by depositing an insulating material on the surface of the body 10 by a thin film process, or by applying an insulating resin to the surface of the body 10 by screen printing or the like.

First Modification of First Embodiment

Figure 5:
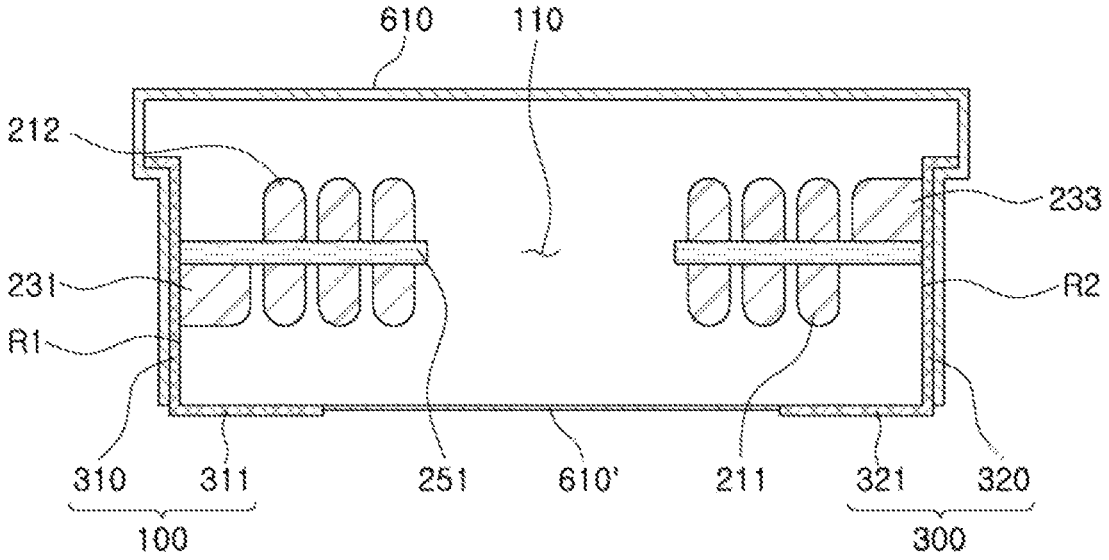
FIG. 5 is a view illustrating a coil component according to a first modification of the first embodiment of the present disclosure, which corresponds to a section taken along line I-I' in FIG. 1.
Figure 6:
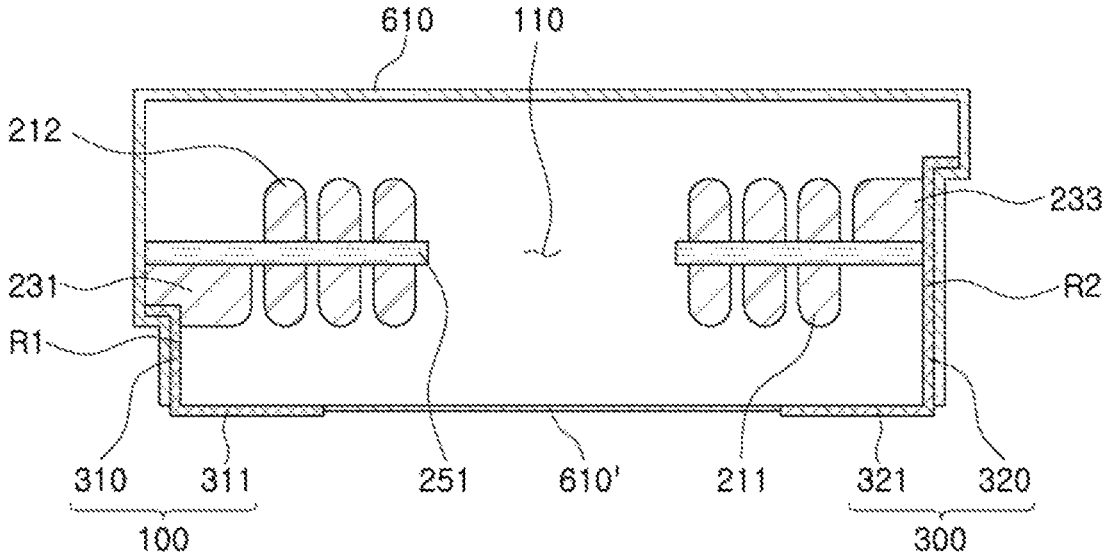
FIG. 6 is a view illustrating a coil component according to a first modification of the first embodiment of the present disclosure, which corresponds to a section taken along line I-I' of FIG. 1.
Figure 7:
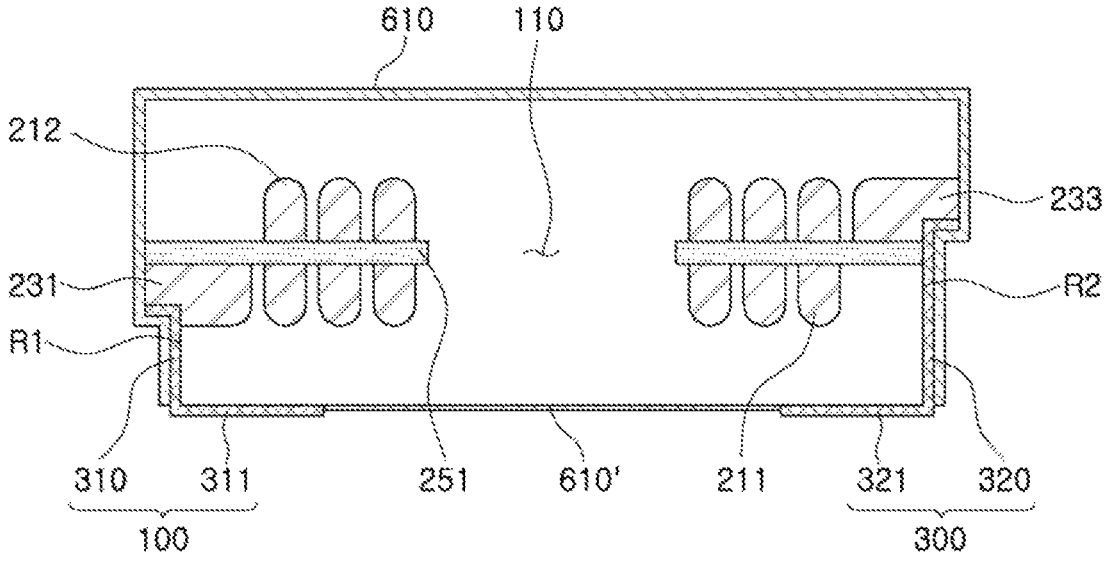
FIG. 7 is a view illustrating a coil component according to a first modification of the first embodiment of the present disclosure, which corresponds to a section taken along line I-I' of FIG. 1.

FIG. 5 is a view illustrating a coil component according to a first modification of the first embodiment, which corresponds to a section taken along line I-I' in FIG. 1. FIG. 6 is a view illustrating a coil component according to a first modification of the first embodiment, which corresponds to a section taken along line I-I' in FIG. 1. FIG. 7 is a view illustrating a coil component according to a first modification of the first embodiment, which corresponds to a section taken along line I-I' in FIG. 1.

Referring to FIGS. 5 to 7, a coil component 1000 according to a first modification of the first embodiment is different from the coil component 1000 according to the first embodiment in that the auxiliary lead portions 241, 242, 243 and 244 are absent. Therefore, in describing this modification, only the auxiliary lead portions 241, 242, 243 and 244 and the lead portions 231, 232, 233 and 234 that are different from the first embodiment will be described. Descriptions of the remaining configurations of this embodiment may be substituted with those of the first embodiment as it is.

Referring to FIG. 5, the first and second recesses R1 and R2 are formed to penetrate through a lower portion and an upper portion of the first and third lead portions 231 and 233, respectively, such that the first and third lead portions 231 and 233 are exposed to the inner walls of the first and second recesses R1 and R2, which is merely an example. Therefore, the depths of the first recess R1 and the second recess R2 may be formed to be different from each other in the thickness direction by adjusting the depths thereof at the time of pre-dicing.

Referring to FIG. 6, in an example without any limitation, the recesses R1 and R2 may be formed to have depths sufficient to penetrate through the third lead portion 233 but to not penetrate through the first lead portion 231. In this case, the third lead portion 233 may be exposed to the inner wall of the second recess R2, and the first lead portion 231 may be exposed to the inner wall and bottom surface of the first recess R1.

Referring to FIG. 7, the recesses R1 and R2 may be formed to not entirely penetrate through both the first and third lead portions 231 and 233. In this case, both the first and third lead portions 231 and 233 may be exposed to the inner walls and the bottom surfaces of the first and second recesses R1 and R2. Since the first lead portion 231 is located on a lower surface of the first insulating substrate 251 and the third lead portion 233 is located on an upper surface of the first insulating substrate 251, depths of the first and second recesses R1 and R2 are different from each other. For example, the recesses R1 and R2 have different depths depending on the presence of the auxiliary lead portions 242, 242, 243 and 244 and the positions of the lead portions 231, 232, 233 and 234.

Second Modification of First Embodiment

Figure 8:
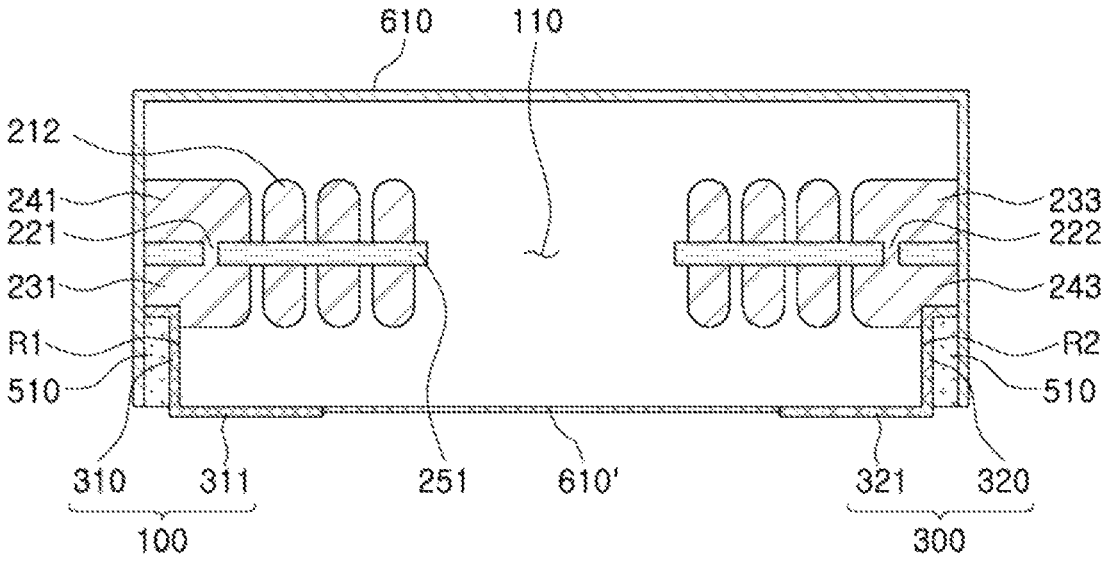
FIG. 8 is a view illustrating a coil component according to a second modification of the first embodiment of the present disclosure, which corresponds to FIG. 4.
Figure 9:
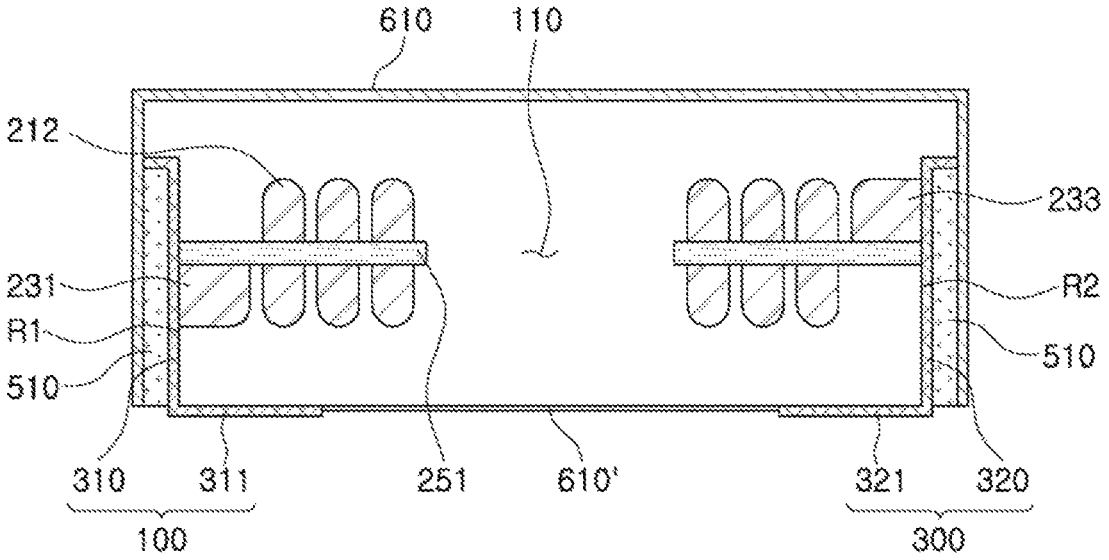
FIG. 9 is a view illustrating a coil component according to a second modification of the first embodiment of the present disclosure, corresponding to FIG. 5.
Figure 10:
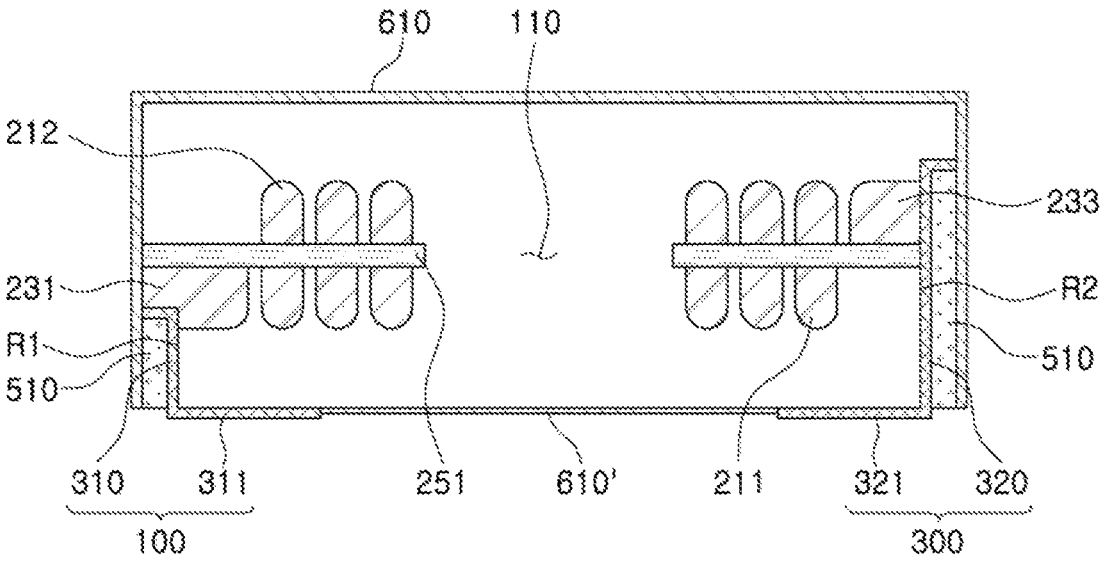
FIG. 10 is a view illustrating a coil component according to a second modification of the first embodiment of the present disclosure, corresponding to FIG. 6.
Figure 11:
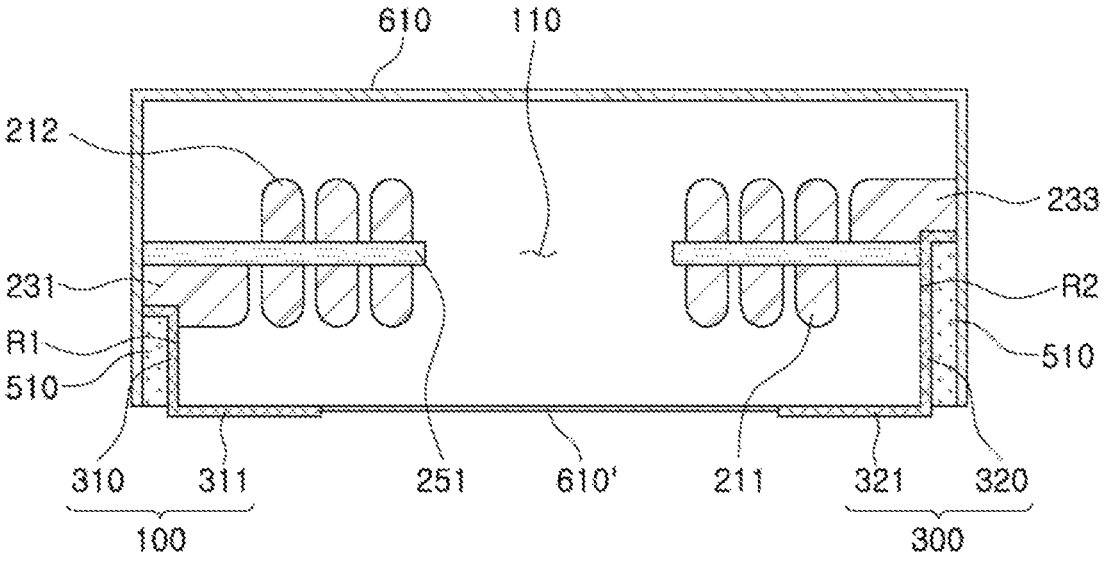
FIG. 11 is a view illustrating a coil component according to a second modification of the first embodiment of the present disclosure, corresponding to FIG. 7.

FIG. 8 is a view illustrating a coil component according to a second modification of the first embodiment, which corresponds to FIG. 4. FIG. 9 is a view illustrating a coil component according to a second modification of the first embodiment, which corresponds to FIG. 5. FIG. 10 is a view illustrating a coil component according to a second modification of the first embodiment, which corresponds to FIG. 6. FIG. 11 is a view illustrating a coil component according to a second modification of the first embodiment, which corresponds to FIG. 7.

Referring to FIGS. 8 to 11, a coil component 1000 according to a second modification of the first embodiment further includes a filling portion 510, as compared with the coil component 1000 according to the first embodiment and the first modification of the first embodiment.

Therefore, in describing the modifications, only the filling portion 510 and an insulating layer 610 covering the filling portion 510, which are different from the first embodiment and the first modification thereof, will be described. Descriptions of the remaining configuration of this embodiment may be with those of the first embodiment and the first modification of the first embodiment as it is.

The filling portion 510 fills the first and second recesses R1 and R2 and covers the connection portions 310 and 320. For example, according to an embodiment of the present disclosure, a structure in which the connection portions 310 and 320 are disposed between the filling portions 510 and the inner surfaces of the recesses R1 and R2, respectively.

Referring to FIG. 8, the first recess R1 partially, respectively penetrates through the first lead portion 231 and the third auxiliary lead portion 243, and thus, the first lead portion 231 and the third auxiliary lead portion 243 are exposed to the inner walls of the first and second recesses R1 and R2. In this case, the filling portion 510 fills the first and second recesses R1 and R2, and cover the connection portions 310 and 320 connecting the first lead portion 231 and the third auxiliary lead portion 243 to the first and third external electrodes 100 and 300, respectively.

Referring to FIG. 9, the first and second recesses R1 and R2 are formed to penetrate through the first and third lead portions 231 and 233, respectively, such that the first and third lead portions 231 and 233 are exposed to the inner walls of the first and second recesses R1 and R2, respectively. In this case, the filler 510 fills the first and second recesses R1 and R2, and covers the connection portions 310 and 320 connecting the first and third lead portions 231 and 233 and the first and third external electrodes 100 and 300, respectively.

Referring to FIG. 10, in an example without any limitation, the recesses R1 and R2 may be formed to have depths sufficient to penetrate through the third lead portion 233 but to not penetrate through the first lead portion 231. In this case, the third lead portion 233 is exposed to the inner wall of the second recess R2, and the first lead portion 231 is exposed to both the inner wall and the bottom surface of the first recess R1. In this case, the filling portion 510 fills the first and second recesses R1 and R2, and covers the connection portions 310 and 320 connecting the first and third lead portions 231 and 233 and the first and third external electrodes 100 and 300, respectively.

Referring to FIG. 11, the recesses R1 and R2 may also be formed to not entirely penetrate through both the first and third lead portions 231 and 233. In this case, both the first and third lead portions 231 and 233 are exposed to the inner walls and the bottom surfaces of the first and second recesses R1 and R2. The filling portion 510 fills the first and second recesses R1 and R2 and covers the connection portions 310 and 320 connecting the first and third lead portions 231 and 233 and the first and third external electrodes 100 and 300, respectively.

One surface of the filling portion 510 may be disposed on substantially the same plane as each of the first to fourth surfaces, the plurality of wall surfaces of the body 10. For example, by forming the external electrodes 100, 200, 300 and 400 in the coil bar state, and by filling the space between connection portions of adjacent bodies with a material for formation of the filling portion and performing full dicing, one surface of the filling portion 510 may be disposed on substantially the same plane as each of the first to fourth surfaces of the body 10.

The filling portion 510 may include an insulating resin. The insulating resin may include, but is not limited to, an epoxy, a polyimide, a liquid crystal polymer, or the like, alone or in combination.

The filling portion 510 may further include magnetic powder dispersed in the insulating resin. The magnetic powder may be ferrite or a magnetic metal powder.

The ferrite powder may be at least one or more of spinel type ferrite such as Mg—Zn type, Mn—Zn type, Mn—Mg type, Cu—Zn type, Mg—Mn—Sr type, Ni—Zn type or the like, hexagonal ferrite such as Ba—Zn type, Ba—Mg type, Ba—Ni type, Ba—Co type, Ba—Ni—Co type or the like, garnet type ferrite such as Y type or the like, and Li-type ferrite.

The magnetic metal powder may include one or more selected from the group consisting of iron (Fe), silicon (Si), chromium (Cr), cobalt (Co), molybdenum (Mo), aluminum (Al), niobium (Nb), copper (Cu) and nickel (Ni). For example, the magnetic metal powder may be at least one or more of pure iron powder, Fe—Si-based alloy powder, Fe—Si—Al based alloy powder, Fe—Ni based alloy powder, Fe—Ni—Mo based alloy powder, Fe—Ni—Mo—Cu based alloy powder, Fe—Co based alloy powder, Fe—Ni—Co based alloy powder, Fe—Cr based alloy powder, Fe—Cr—Si based alloy powder, Fe—Si—Cu—Nb based alloy powder, Fe—Ni—Cr based alloy powder, and Fe—Cr—Al based alloy powder.

The magnetic metal powder may be amorphous or crystalline. For example, the magnetic metal powder may be an Fe—Si—B—Cr based amorphous alloy powder, but is not limited thereto.

The ferrite and the magnetic metal powder may have an average diameter of about 0.1 μm to 30 μm, respectively, but embodiments thereof are not limited thereto.

The insulating layer 610 may be formed to surround all the configurations in the above-described embodiments, except for the sixth surface of the body 10, the extension portions 311 and 321 disposed on the sixth surface of the body 10 and a region of the filling portion 510 exposed to the sixth surface of the body 10.

The insulating layer 610 may include at least one of a thermoplastic resin such as a polystyrene type resin, a vinyl acetate type resin, a polyester type resin, a polyethylene type resin, a polypropylene type resin, a polyamide type resin, a rubber type resin or an acrylic type resin, a thermosetting resin such as a phenol type resin, an epoxy type resin, a urethane type resin, a melamine type resin or an alkyd type resin, a photoimageable dielectric resin, parylene, $SiO_x$, or $SiN_x$.

The insulating layer 610 may be formed by laminating a cover film such as a dry film (DF) on the body 10 on which the filling portion 510 is formed. Alternatively, the insulating layer 610 may be formed by forming an insulating material on the body 10 on which the filling portion 510 is formed by vapor deposition such as chemical vapor deposition (CVD) or the like.

The insulating layer 610 may be formed in a thickness range of 10 nm to 100 μm. If the thickness of the insulating layer 610 is less than 10 nm, electrical short between the connection portions 310 and 320 and/or the lead portions 231, 232, 233 and 234 and other external electronic components may occur due to decreased insulation characteristics. If the thickness of the insulating layer 610 is more than 100 μm, the total length, width, and thickness of the coil component increase, which is disadvantageous for thinning.

As such, in the case of the coil component 1000 according to this embodiment, a lower electrode structure may be easily implemented while maintaining the size of the coil component. For example, unlike the related art in which the external electrodes are formed on respective bodies separated by the full dicing; in embodiments of the present disclosure, since the external electrodes are formed on the body in the state of the coil bar in which the plurality of bodies are connected to each other, a defect rate may be significantly reduced, as compared with the case in which external electrodes are individually formed on respective bodies.

In addition, in the coil component 1000 according to this embodiment, since the external electrodes 100, 200, 300 and 400 are not disposed on the first to fourth surfaces which are the plurality of wall surfaces of the body 10, the length and width of the coil component 1000 may be prevented from increasing. Further, since the external electrodes 100, 200, 300 and 400 are formed to have a relatively reduced thickness, the entire thickness of the coil component 1000 may be reduced.

In this embodiment, the external electrodes 100, 200, 300 and 400 may be prevented from being electrically short-circuited to other external electronic components by forming the filling portion 510 including an insulating resin in the recesses R1 and R2. In this case, when the coil component 1000 according to this embodiment is mounted on a substrate or the like, the filling portion 510 may prevent that a coupling member such as solder or the like is extended to the first to fourth surface sides of the body 10. In addition, when the filling portion 510 includes a magnetic substance, magnetic substance loss of the body 10 due to the formation of the recesses R1 and R2 may be compensated.

Second Embodiment

Figure 12:
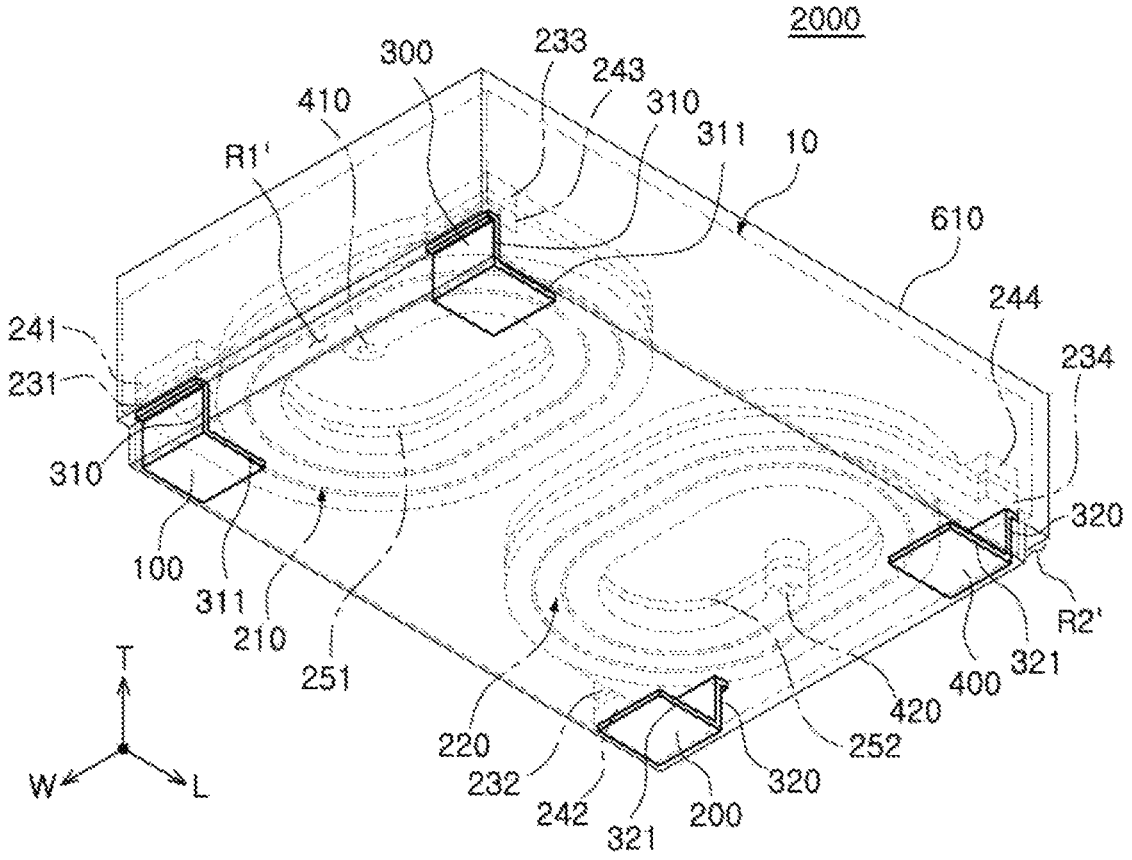
FIG. 12 is a side perspective view of a coil component according to the second embodiment of the present disclosure, viewed from the lower side.

FIG. 12 is a side perspective view of a coil component according to a second embodiment of the present disclosure, viewed from the lower side.

Referring to FIG. 12, a coil component 2000 according to an embodiment differs from the coil component 1000 according to the first embodiment, in terms of an arrangement of recesses in outer surface of the body 10. Therefore, in describing this embodiment, only the arrangement of recesses different from that of the first embodiment will be described. Descriptions of the remaining configurations of this embodiment may be substituted with the descriptions of the first embodiment and the modifications thereof.

Referring to FIG. 12, the body 10 has a first surface and a second surface opposing each other in the width direction W, a third surface and a fourth surface opposing each other in the length direction L, and a fifth surface and a sixth surface opposing each other in the thickness direction T. The first to fourth surfaces of the body 10 correspond to wall surfaces of the body 10, connecting the fifth and sixth surfaces of the body 10 to each other. The fifth and sixth surfaces of the body 10 may refer to the other surface and one surface of the body, and the third and the fourth surfaces of the body opposing each other among the plurality of wall surfaces of the body may refer to both end surfaces of the body.

Referring to FIG. 12, a first recess R1' is formed on the third surface to extend to the sixth surface, and a second recess R2' is formed on the fourth surface opposing the third surface, to extend to the sixth surface. For example, in this embodiment, the first and second recesses R1' and R2' are disposed on the third surface and the fourth surface of a rectangular parallelepiped body 10, opposing each other in the length direction L, respectively. The recesses R1' and R2' are formed along the entire edge regions formed by the third and fourth surfaces of the body 10 and the sixth surface of the body 10, respectively. The recesses R1' and R2' do not extend to the fifth surface of the body 10. For example, the recesses R1' and R2' do not penetrate through the body 10 in the thickness direction of the body 10.

Third Embodiment

Figure 13:
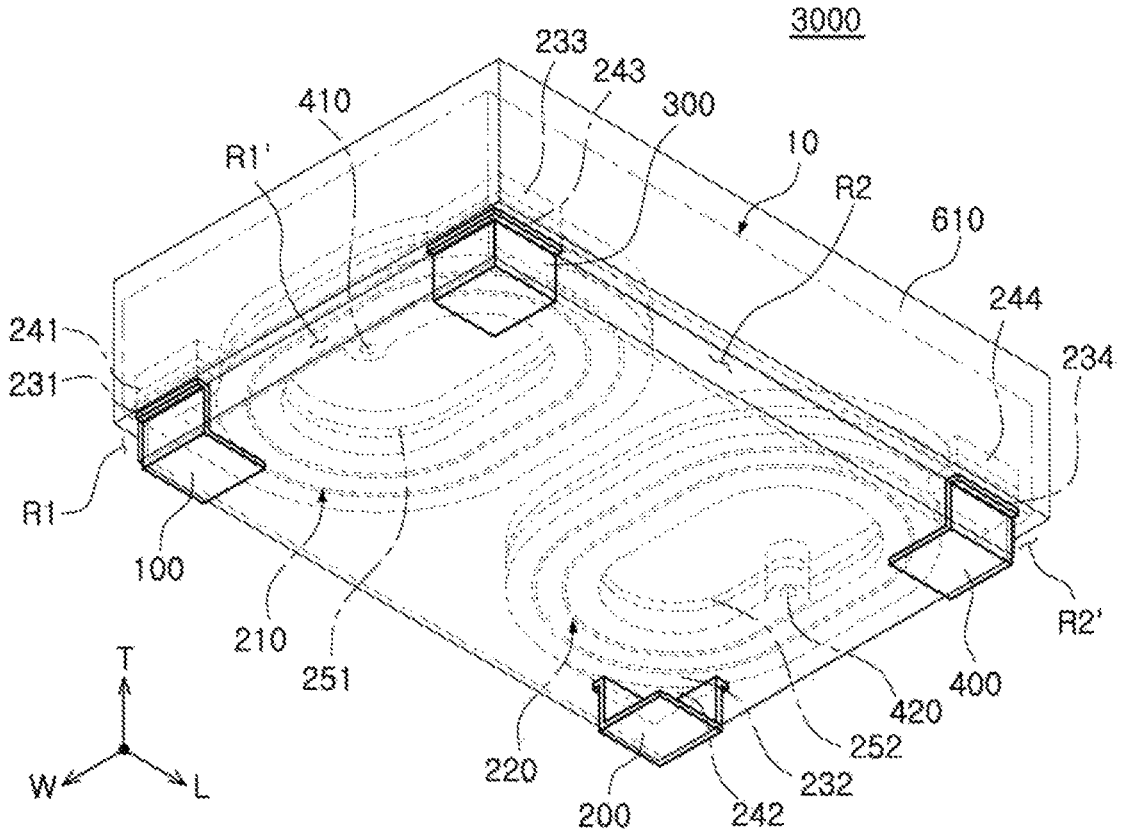
FIG. 13 is a side perspective view of a coil component according to a third embodiment of the present disclosure, viewed from the lower side.

FIG. 13 is a side perspective view of a coil component according to a third embodiment, viewed from the lower side.

Referring to FIG. 13, a coil component 3000 according to an embodiment differs from the coil component 1000 according to the first embodiment in terms of the arrangement of recesses in outer surfaces of the body 10. Therefore, in describing this embodiment, only the arrangement of recesses different from those of the first and second embodiments will be described. Descriptions of the remaining configurations of this embodiment may be substituted with those of the first embodiment and the modifications thereof.

Recesses R1, R1', R2 and R2' extend to both sides of the body 10 connecting two opposite end surfaces among a plurality of wall surfaces of the body. In this embodiment, first and second recesses refer to recesses located on either one of two pairs of opposite surfaces among the plurality of wall surfaces of the body, and for convenience of explanation, first to fourth recesses will be described. For example, in this embodiment, third and fourth recesses R1' and R2' are disposed on the first and second surfaces of the body 10 opposing each other in the length direction L of the body 10, respectively, and first and first recesses R1 and R2 are disposed on the third and fourth surfaces of the body 10 opposing each other in the width direction W, respectively. Referring to FIG. 13, the first recess R1 is formed on the third surface to extend to the sixth surface, the second recess R2 is formed on the fourth surface opposing the third surface to extend to the sixth surface. The third recess R1' is formed on the first surface to extend to the sixth surface, and the fourth recess R2' is formed on the second surface opposing the first surface to extend to the sixth surface. The recesses R1, R1', R2 and R2' are formed along the entire edge regions formed by the first to fourth surfaces of the body 10 and the sixth surface of the body 10, respectively. The recesses R1, R1', R2 and R2' do not extend to the fifth surface of the body 10. For example, the recesses R1, R1', R2 and R2' do not penetrate through the body 10 in the thickness direction of the body 10.

Fourth Embodiment

Figure 14:
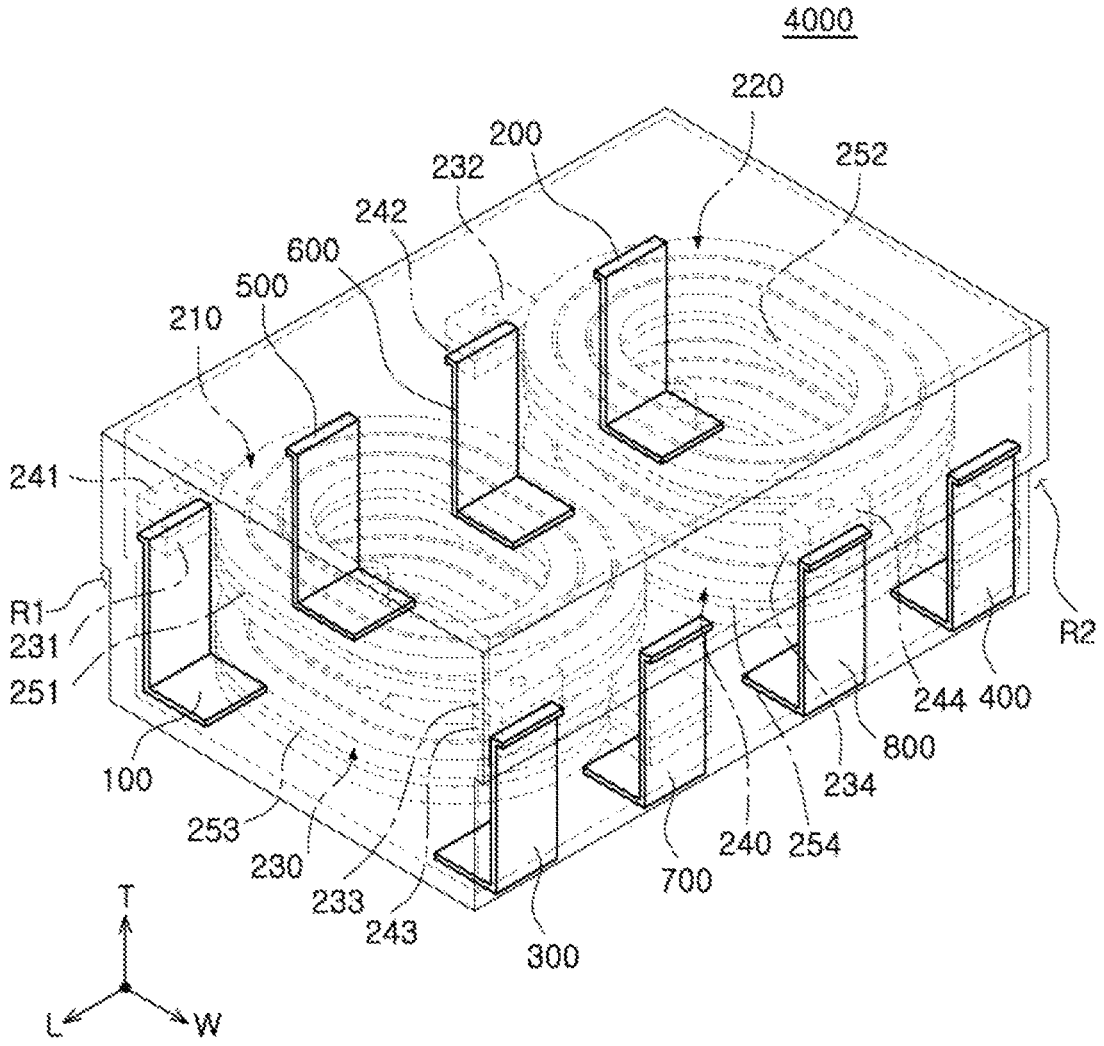
FIG. 14 is a side perspective view schematically illustrating a coil component according to a fourth embodiment of the present disclosure.

FIG. 14 is a side perspective view schematically illustrating a coil component according to a fourth embodiment.

Referring to FIG. 14, a coil component 4000 according to this embodiment may further include at least one pair of coil components in the thickness direction as compared with the coil component 1000 according to the first embodiment. Therefore, in describing this embodiment, only a plurality of coil portions and a plurality of external electrodes different from those of the first to third embodiments will be described. Descriptions of the remaining configurations of this embodiment may be substituted with those of the first to third embodiments. Although this embodiment illustrates that two insulating substrates, two coil portions, two recesses, and four external electrodes are further included, respectively, as those of the first embodiment, but embodiments of the present disclosure are not limited thereto. For convenience of explanation, a plurality of insulating substrates, a plurality of coil portions, a plurality of recesses, and a plurality of external electrodes are provided.

Referring to FIG. 14, the body 10 may further include a plurality of insulating substrates spaced apart from each other, not only in the length direction L but also in the thickness direction T. A third insulating substrate 253 spaced apart from a first insulating substrate 251 in the thickness direction, and a fourth insulating substrate 254 spaced apart from a second insulating substrate 252 in the thickness direction may be further included in the body 10.

First and second recesses R1 and R2 may be formed on both side surfaces of the body, opposing each other, among a plurality of wall surfaces of the body 10, respectively, and may extend to one surface of the body. FIG. 14 illustrates a structure in which the first and second recesses R1 and R2 are disposed on the third and fourth surfaces opposing each other in the width direction, respectively, among the first to fourth surfaces, but an embodiment thereof is not limited thereto. For example, third and fourth recesses R1' and R2' may be disposed on the first and second surfaces opposing each other in the length direction, respectively. In this case, the third and fourth recesses R1' and R2' may be represented by first and second recesses R1 and R2 for convenience of explanation.

According to this embodiment, a plurality of coil portions are disposed on first to fourth insulating substrates 251, 252, 253 and 254, in such a manner that one ends thereof are respectively exposed to the first recess R1 and the other ends thereof are respectively exposed to the second recess R2. For example, one ends and the other ends of the first to fourth coil portions 210, 220, 230 and 240 are respectively exposed to the first and second recesses R1 and R2.

According to this embodiment, a plurality of first external electrodes are formed along an inner surface of the first recess R1 and one surface of the body, and are spaced apart from each other and connected to one ends of the plurality of coil portions, respectively. In addition, a plurality of second external electrodes are formed along an inner surface of the second recess R2 and one surface of the body, and are spaced apart from each other and connected to the other ends of the plurality of coil portions, respectively.

As set forth above, according to an embodiment, the size of a coil component may be reduced.

According to an embodiment, formation of a lower electrode structure may be facilitated.

According to an embodiment, loss of a magnetic substance may be significantly reduced.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A coil component comprising:

a body having a first surface and a second surface opposing each other, and a plurality of wall surfaces respectively connecting the first surface and the second surface of the body;

a first insulating substrate and a second insulating substrate spaced apart from each other in the body;

a first recess and a second recess disposed respectively in first and second wall surfaces of the body, opposing each other among the plurality of wall surfaces of the body, the first and second recesses extending to the first surface of the body, each of the first and second recesses having a bottom surface facing the second surface of the body and an inner wall respectively along the first and second wall surfaces of the body;

a first coil portion and a second coil portion disposed on the first and second insulating substrates, respectively, a first end of each of the first and second coil portions being exposed to the inner wall and the bottom surface of the first recess and a second end of each of the first and second coil portions being exposed to the inner wall and/or the bottom surface of the second recess;

a first external electrode and a second external electrode respectively disposed along an inner surface of the first recess and the first surface of the body, and spaced apart from each other and connected to the first ends of the first and second coil portions, respectively; and a third external electrode and a fourth external electrode respectively disposed along an inner surface of the second recess and the first surface of the body, and spaced apart from each other and connected to the second ends of the first and second coil portions, respectively.

2. The coil component of claim 1, wherein the first end of the first coil portion comprises a first lead portion disposed on a first surface of the first insulating substrate and connected to the first external electrode, the second end of the first coil portion comprises a third lead portion disposed on a second surface of the first insulating substrate opposing the first surface of the first insulating substrate and connected to the third external electrode, the first end of the second coil portion comprises a second lead portion disposed on a first surface of the second insulating substrate and connected to the second external electrode, and the second end of the second coil portion comprises a fourth lead portion disposed on a second surface of the second insulating substrate opposing the first surface of the second insulating substrate and connected to the fourth external electrode.

3. The coil component of claim 2, wherein the first and second lead portions are exposed to the inner wall of the first recess, and the third and fourth lead portions are exposed to the inner wall of the second recess.

4. The coil component of claim 2, wherein the first and second lead portions are exposed to the inner wall and the bottom surface of the first recess, and the third and fourth lead portions are exposed to the inner wall and the bottom surface of the second recess.

5. The coil component of claim 2, wherein the first end of the first coil portion comprises a first auxiliary lead portion disposed on the second surface of the first insulating substrate and facing the first lead portion, the second end of the first coil portion comprises a third auxiliary lead portion disposed on the first surface of the first insulating substrate and facing the third lead portion, the first end of the second coil portion comprises a second auxiliary lead portion disposed on the second surface of the second insulating substrate and facing the second lead portion, the second end of the second coil portion comprises a fourth auxiliary lead portion disposed on the first surface of the second insulating substrate and facing the fourth lead portion, the first auxiliary lead portion of the first coil portion and the second auxiliary lead portion of the second coil portion are respectively exposed to the first recess, and the third auxiliary lead portion of the first coil portion and the fourth auxiliary lead portion of the second coil portion are respectively exposed to the second recess.

6. The coil component of claim 1, wherein each of the first to fourth external electrodes comprises a connection portion disposed in the first and second recesses and an extension portion disposed on the first surface of the body, wherein the connection portion and the extension portion are integrated with the bottom surfaces of the first and second recesses, the inner walls of the first and second recesses and the first surface of the body.

7. The coil component of claim 6, further comprising an insulating layer disposed on the body and the first to fourth external electrodes, wherein the insulating layer is disposed along the inner walls and the bottom surfaces of the first and second recesses to cover the connection portion of each of the first to fourth external electrodes and to expose the extension portion of each of the first to fourth external electrodes.

8. The coil component of claim 6, further comprising a filling portion filling the first and second recesses and covering the connection portion.

9. The coil component of claim 8, wherein a first surface of the filling portion is substantially coplanar with each of the plurality of wall surfaces of the body.

10. The coil component of claim 8, wherein the filling portion comprises an insulating resin.

11. The coil component of claim 10, wherein the filling portion further comprises a magnetic powder dispersed in the insulating resin.

12. The coil component of claim 1, wherein each of the first and second recesses extends to both sides of the body, connecting both the first and second wall surfaces of the body, among the plurality of wall surfaces of the body.

13. A coil component comprising:

a body having a first surface and a second surface opposing each other, and a plurality of wall surfaces respectively connecting the first surface and the second surface of the body;

a plurality of insulating substrates spaced apart from each other in the body;

a first recess and a second recess disposed in first and second wall surfaces of the body, opposing each other, among the plurality of wall surfaces of the body, respectively, the first and second recesses extending to the first surface of the body, each of the first and second recesses having a bottom surface facing the second surface of the body and an inner wall respectively along the first and second wall surfaces of the body;

a plurality of coil portions disposed on the plurality of insulating substrates, respectively, first ends of the plurality of coil portions being exposed to the bottom surface and the inner wall of the first recess and second ends of the plurality of coil portions being exposed to the inner wall and/or the bottom surface of the second recess;

a plurality of first external electrodes respectively disposed along an inner surface of the first recess and the first surface of the body, and spaced apart from each other and connected to the first ends of the plurality of coil portions, respectively; and a plurality of second external electrodes respectively disposed along an inner surface of the second recess and the first surface of the body, and spaced apart from each other and connected to the second ends of the plurality of coil portions, respectively.

14. A coil component comprising:

a body having a lower surface, an upper surface and walls extending between the lower and upper surfaces;

a coil portion disposed on an insulating substrate, the coil portion and the insulating substrate being disposed in the body;

a first recess disposed along a first wall of the body, extending from the lower surface of the body, the first recess having an upper surface facing the upper surface of the body and a side surface along the first wall, wherein a first end of the coil portion is disposed to be in direct contact with the upper surface and the side surface of the first recess;

a second recess disposed along a second wall of the body opposite the first wall, extending from the lower surface of the body, the second recess having an upper surface facing the upper surface of the body and a side surface along the second wall, wherein a second end of the coil portion is disposed to be in direct contact with the upper surface and/or the side surface of the second recess;

a first external electrode connected to the first end of the coil portion and disposed along the lower surface of the body and a surface of the first recess; and a second external electrode connected to the second end of the coil portion and disposed along the lower surface of the body and a surface of the second recess.

15. The coil component of claim 14, wherein each of the first and second external electrodes comprises a connection portion disposed on respective upper surfaces and the inner walls of the first and second recesses, and an extension portion disposed on the lower surface of the body, wherein the connection portions are connected to respective extension portions.

16. The coil component of claim 15, further comprising an insulating layer disposed on the body, covering the connection portions of the first and second external electrodes and exposing the extension portions of the first and second external electrodes.

17. The coil component of claim 16, further comprising a filling portion filling the first and second recesses, the filling portion being disposed between the connection portions of the first and second external electrodes and the insulating layer.

18. The coil component of claim 14, wherein the first end of the coil portion comprises a first lead portion disposed on a first surface of the insulating substrate and a first auxiliary lead portion disposed on a second surface of the insulating substrate connected to the first lead portion by a via penetrating the insulating substrate, the second end of the coil portion comprises a second lead portion disposed on a first surface of the insulating substrate and a second auxiliary lead portion disposed on a second surface of the insulating substrate connected to the second lead portion by a via penetrating the insulating substrate, and the first and second recesses respectively contact either of the first lead portion or the first auxiliary lead portion and either of the second lead portion or the second auxiliary lead portion.

19. A coil component comprising:

a body having a lower surface, an upper surface and walls extending between the lower and upper surfaces;

a coil portion disposed on an insulating substrate, the coil portion and the insulating substrate being disposed in the body;

a first recess disposed along a first wall of the body, extending from the lower surface of the body and contacting a first end of the coil portion, the first recess having an upper surface facing the upper surface of the body;

a second recess disposed along a second wall of the body opposite the first wall, extending from the lower surface of the body and contacting a second end of the coil portion, the second recess having an upper surface facing the upper surface of the body;

a first external electrode connected to the first end of the coil portion and disposed along the lower surface of the body and bent along the upper surface of the first recess; and a second external electrode connected to the second end of the coil portion and disposed along the lower surface of the body and bent along the upper surface of the second recess.

20. The coil component of claim 19, further comprising an insulating layer disposed on the body, covering portions of the first and second external electrodes that are bent along the upper surface of the first and second recesses and exposing portions of the first and second external electrodes disposed along the lower surface of the body.

* * * * *